US005892221A

United States Patent [19]

Lev

[11] Patent Number: 5,892,221

[45] Date of Patent: Apr. 6, 1999

[54] COMBAT SIMULATION METHOD AND SYSTEM UTILIZING LASERS WITH WIRELESS ACTIVATION

[76] Inventor: Shlomo Lev, Aharonovitz 25, Holon, Israel

[21] Appl. No.: 823,672

[22] Filed: Mar. 24, 1997

[51] Int. Cl.[6] ..... G01V 9/04

[52] U.S. Cl. ..... 250/222.1; 250/203.1; 359/152; 434/22; 463/52

[58] Field of Search ..... 250/222.1, 203.1, 250/214 R; 356/4.02, 6, 28; 42/103; 273/317.1; 434/22, 21; 463/52, 56; 359/142, 152, 154

[56] References Cited

U.S. PATENT DOCUMENTS

| | | | |
|---|---|---|---|
| 4,500,206 | 2/1985 | Cole et al. | 356/376 |
| 4,561,849 | 12/1985 | Eichweber | 434/22 |
| 4,569,666 | 2/1986 | Wolf | 446/308 |
| 4,592,554 | 6/1986 | Gilbertson | 434/22 |
| 4,688,934 | 8/1987 | Clark | 356/34 |
| 4,934,086 | 6/1990 | Houde-Walter | 42/103 |
| 5,137,353 | 8/1992 | Seegmiller | 356/152 |
| 5,179,235 | 1/1993 | Toole | 42/103 |
| 5,407,149 | 4/1995 | Singhai | 244/1 R |
| 5,435,091 | 7/1995 | Toole et al. | 42/103 |
| 5,509,226 | 4/1996 | Houde-Walter | 42/103 |

*Primary Examiner*—Que T. Le
*Attorney, Agent, or Firm*—Mark M. Friedman

[57] ABSTRACT

A combat simulation system to be used with models of weapons platforms to simulate firing and target "hits", and to register the firing and the hits, including a remote control, operated by a user, for activating a source of coherent electromagnetic radiation, a target which may be substantially enfilade by the coherent electromagnetic radiation source, an electromagnetic radiation detector situated to receive reflected radiation from the target, and a transmitter for transmitting from the coherent electromagnetic radiation detector to a receiver. According to the present invention, a predator platform including both a coherent electromagnetic radiation source and a coherent electromagnetic radiation detector is maneuvered to a firing position where a target platform is within line of sight of the radiation source. The user activates the radiation source thereby emitting a radiation burst which is reflected from the target platform and picked up by the radiation detector.

22 Claims, 6 Drawing Sheets

COMBAT SIMULATION METHOD AND SYSTEM UTILIZING LASERS WITH WIRELESS ACTIVATION

FIELD AND BACKGROUND OF THE INVENTION

The present invention relates to combat simulations and, in particular, the invention concerns a combat simulation method and system to be used with models of weapon platforms to simulate firing and target "hits", and to register the firing and the hits.

Since the invention of weapons, a simple and efficient way to simulate combat was sought. For many years individuals used models of weapon systems to simulate various combat scenarios. The various models and devices included, among others, scaled model tanks and scaled artillery models utilizing a single shot 0.22 inch gun to simulate tank and artillery fire. Alternatively, models equipped with a fusil have been used for simulating purposes both with and without shot. There is an obvious hazard in using such models as they may cause the injure or even the death of a user. Other combat simulation models include remote controlled model aircraft for performing aerobatic maneuvers and as pleasurable pastime activities. A relatively undeveloped aspect in using aircraft models, is the simulation of air to air combat by attaching a paper strip to an extremity of each participating aircraft. Typically, the paper strip is attached to the wing-tip of the aircraft. The ultimate goal of the exercise is to maneuver a given aircraft to a position in such close proximity to the "target" aircraft that the propeller of the aircraft maneuvered, severs the paper strip attached to the extremity of the target plane, scoring a "kill". Due to close proximity between aircraft, and high risk of the aircraft contacting, resulting in the loss of the aircraft, the practice of using aircraft models to simulate air to air combat has remained undeveloped. Moreover, simulating air to air combat in the aforementioned manner is limited to inexpensive and simple models due to the high probability of the aircraft getting damaged or destroyed.

Real fighter planes typically utilize a gun mounted camera to simulate firing upon a target. The camera is activated when the pilot depresses the gun trigger and thus enables to ascertain, with a high degree of certainty, whether the target would have been hit if actual rounds were used. The gun mounted camera is an expensive and complex system which may also be of a considerable weight and size and thus would be inappropriate for use on model aircraft. A theoretical simplification of the gun mounted camera by mounting a conventional film loaded camera whose film will be processed once the model aircraft reaches the ground, lacks the real-time element which is needed for realistic combat simulations.

Further combat simulations are attempted by individuals who recreate ground or sea battles using scaled models of the soldiers, weapons and platforms on which they were used. Again, the attempts of recreating or simulating ground or sea battles also suffer from the deficiency of the attempts described.

There is therefore a need for an effective combat simulation system to be used on weapon platform models which simulates firing, target "hits" and registering the firing and the hits.

SUMMARY OF THE INVENTION

The present invention is a combat simulation method system for weapon platform models.

According to the teachings of the present invention there is provided, a combat simulation system including: (a) a first source of coherent electromagnetic radiation; (b) a first remote control, operated by a user, for activating the first source of coherent electromagnetic radiation; (c) a target which can be substantially enfilade by the first coherent electromagnetic radiation source; (d) a first coherent electromagnetic radiation detector situated to receive reflected radiation from the target; and (e) a transmitter responsive to the first coherent electromagnetic radiation detector.

According to further embodiments of the system according to the present invention the system includes a receiver for receiving a signal from the transmitter.

According to still further embodiments of the system according to the present invention the target includes a second coherent electromagnetic radiation source.

According to further embodiments of the system according to the present invention the target includes it's own coherent electromagnetic radiation detector.

According to still further embodiments of the system according to the present invention the target includes a transmitter responsive to the target's coherent electromagnetic radiation detector.

According to further embodiments of the system according to the present invention the system further includes a target remote control for receiving a signal transmitted from the target transmitter.

According to yet further embodiments of the system according to the present invention the target remote control includes a transceiver for activating the second source of coherent electromagnetic radiation.

According to still further embodiments of the system according to the present invention the transceiver includes an indicator responsive to incoming signals from the target transmitter.

According to further embodiments of the system according to the present invention the indicator includes a score board.

According to yet further embodiments of the system according to the present invention the sources of coherent electromagnetic radiation are lasers.

According to the teachings of the present invention there is provided a method for simulating combat between a predator platform and a target platform including the steps of: (a) providing the predator platform with: (i) a first source of coherent electromagnetic radiation; and (ii) a first coherent electromagnetic radiation detector situated to receive reflected radiation from the target platform; (b) maneuvering the predator platform to a position where the target platform is substantially enfilade by the first coherent electromagnetic radiation source; and (c) activating the first coherent electromagnetic radiation source, such that radiation from the first radiation source is be reflected from the target platform and received by the first coherent electromagnetic radiation detector.

According to further embodiments of the method according to the present invention the target includes a source of coherent electromagnetic radiation, and the method further includes the step of deactivating the target radiation source when the target detector detects coherent electromagnetic radiation.

According to yet further embodiments of the method according to the present invention the target further includes: (i) a second source of the coherent electromagnetic radiation; (ii) a second coherent electromagnetic radiation detector situated to receive reflected radiation from a target; and (iii) a second remote control for controlling the target and activating the second radiation source; and the method further includes the step of changing roles between the predator platform and the target.

According to further embodiments of the method according to the present invention the method further includes the step of deactivating the second source of coherent electromagnetic radiation when the target detector detects coherent electromagnetic radiation.

The present invention successfully addresses the shortcomings of the presently known configurations by providing an effective combat simulation method to be used on weapon platform models which simulates firing, target "hits" and registering the firing and the hits.

Typically, aircraft combat simulations are held between two or more aircraft in a pre-defined air envelope which defines minimum and maximum altitudes as well as areas and altitudes where engagement is permitted. Every user or pilot then maneuvers their aircraft to a starting point where the combat commences and each user or pilot starts maneuvering their aircraft until another aircraft is within the line of sight where the user or pilot will activate their weapon system, scoring a "kill". Typically, most users or pilot will try to execute sharp angles of attack which make it harder for a prospective target to successfully perform evasive maneuvers and tactics.

In the case of remote controlled models used in such simulations, the users control the models from the ground and are usually limited to the range of the transmitters in the remote controls. A typical combat simulation of models will take place in the air space immediately above the heads of the users and may include several models attempting to maneuver to a firing position in relation to the other models.

A ship combat simulation will typically take place in a pool or a pond. The simulation will often be a re-creation of a famous battle or may a conventional combat simulation. The users will often attempt to maneuver their ships to a firing position permitting broadside hits. Hits between the bow and the beam are especially favored as they probably would have resulted in the target ship sinking if real shells had been fired.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a method and system which can be used with models of weapon platforms to simulate firing and target "hits", and to register the firing and the hits.

The principles and operation of a combat simulation system according to the present invention may be better understood with reference to the drawings and the accompanying description.

Figure 1:
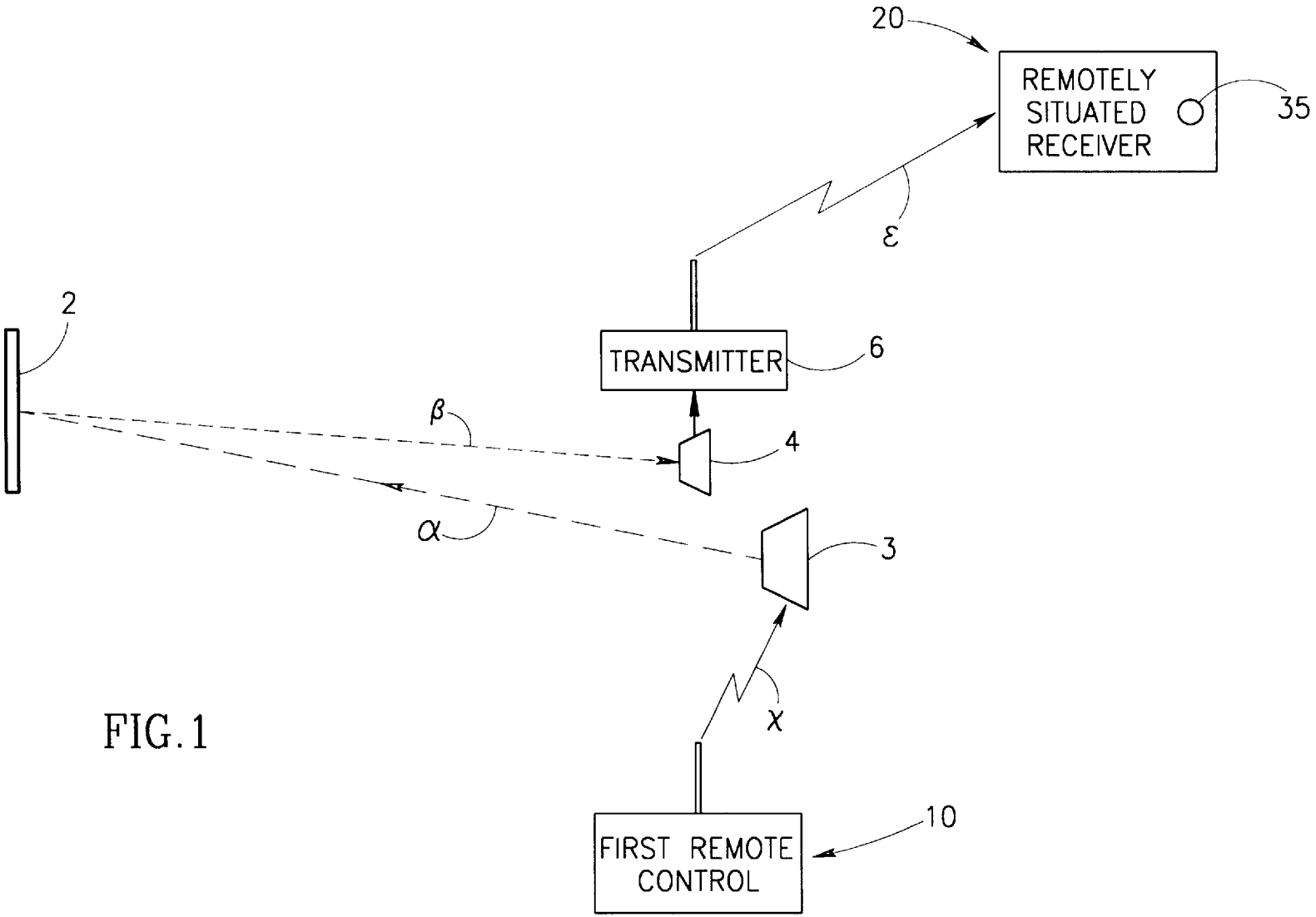
FIG. 1 is a schematic view of the components making up the system according to the present invention.
Figure 1A:
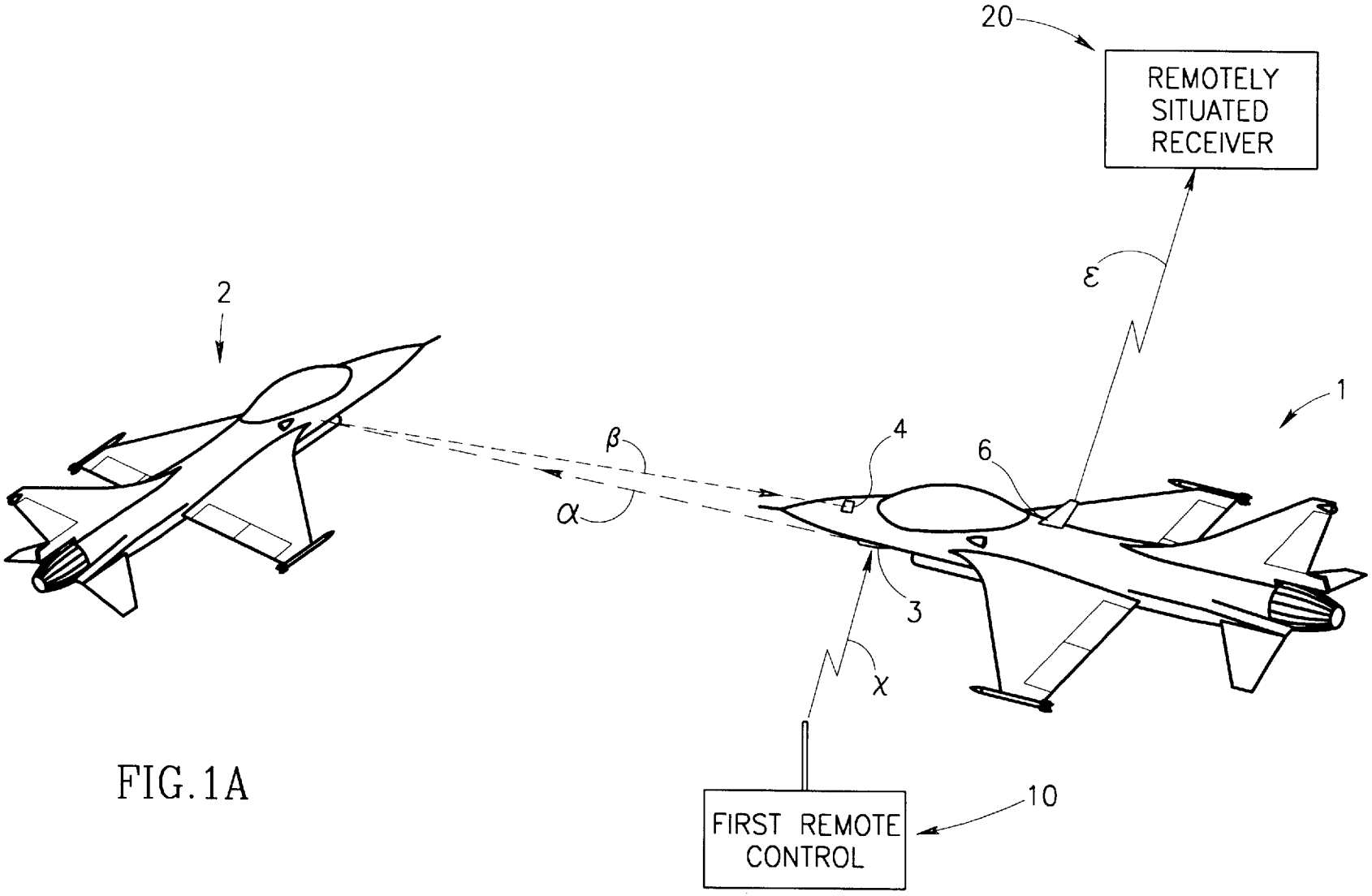
FIG. 1A is a perspective view of the system mounted on model aircraft.

Referring now to the drawings, FIGS. 1 and 1A illustrate the basic components of a system according to the present invention, wherein a first remote control 10, operated by a user, activates a first source of coherent electromagnetic radiation 3. After the user has maneuvered a platform, on which first source of coherent electromagnetic radiation 3 is mounted, into a firing position. First remote control 10 sends a signal along a path, generally indicated as $\chi$, to first source of coherent electromagnetic radiation 3. The coherent electromagnetic radiation, emitted by first source 3, travels along a path generally indicated as $\alpha$, and contacts a target 2 which can be substantially enfilade by first radiation source 3, activating first source 3. The coherent electromagnetic radiation returning from target 2, travels along a path, generally indicated as $\beta$, and is picked up by a coherent electromagnetic radiation detector 4 to receive reflected radiation from target 2. Preferably, first radiation source 3 and detector 4 are suitably mounted on a predator platform 1 (FIG. 1A). Detector 4, after detecting coherent electromagnetic radiation, transfers a signal to a transmitter 6 which is responsive to first radiation source 3. Transmitter 6 transmits the signal traveling along a path, generally indicated as $\epsilon$ and picked up by a remotely situated receiver 20.

Preferably, source of coherent electromagnetic radiation 3 includes a laser. Laser sources sufficiently small and lightweight to be mounted on small model aircraft are well known in the art. Laser sources of such dimensions have been disclosed in U.S. Pat. Nos. 5,179,235 and 5,435,091 granted to Tolle and U.S. Pat. No. 5,509,226 granted to Houde-Walter, to name but a few.

Preferably, receiver 20 features an indicator 35 indicating when detector 4 detects coherent electromagnetic radiation.

More preferably, indicator 35 features a display for displaying the number of times in which detector 4 detects a burst of coherent electromagnetic radiation, and/or a score board Preferably, the predator platform further includes a processor to activate and deactivate detector 4 and first source 3 according to the simulation framework and the predetermined flight envelope in which combat commences and takes place.

Preferably, the system is mounted on weapon platforms as shown in FIG. 1A. Typically, the system will be mounted on model aircraft. First radiation source 3 is mounted on predator model 1. Predator model 1 is maneuvered by the user so that target 2 is within the line of sight of first radiation source 3. Radiation detector 4 is suitably mounted to receive reflected radiation from target 2 along path $\beta$. Detector 4 is also connected to transmitter 6 mounted on predator 1. Detector 4 transmits a signal to receiver 20 after coherent electromagnetic radiation is detected by detector 4.

Figure 2:
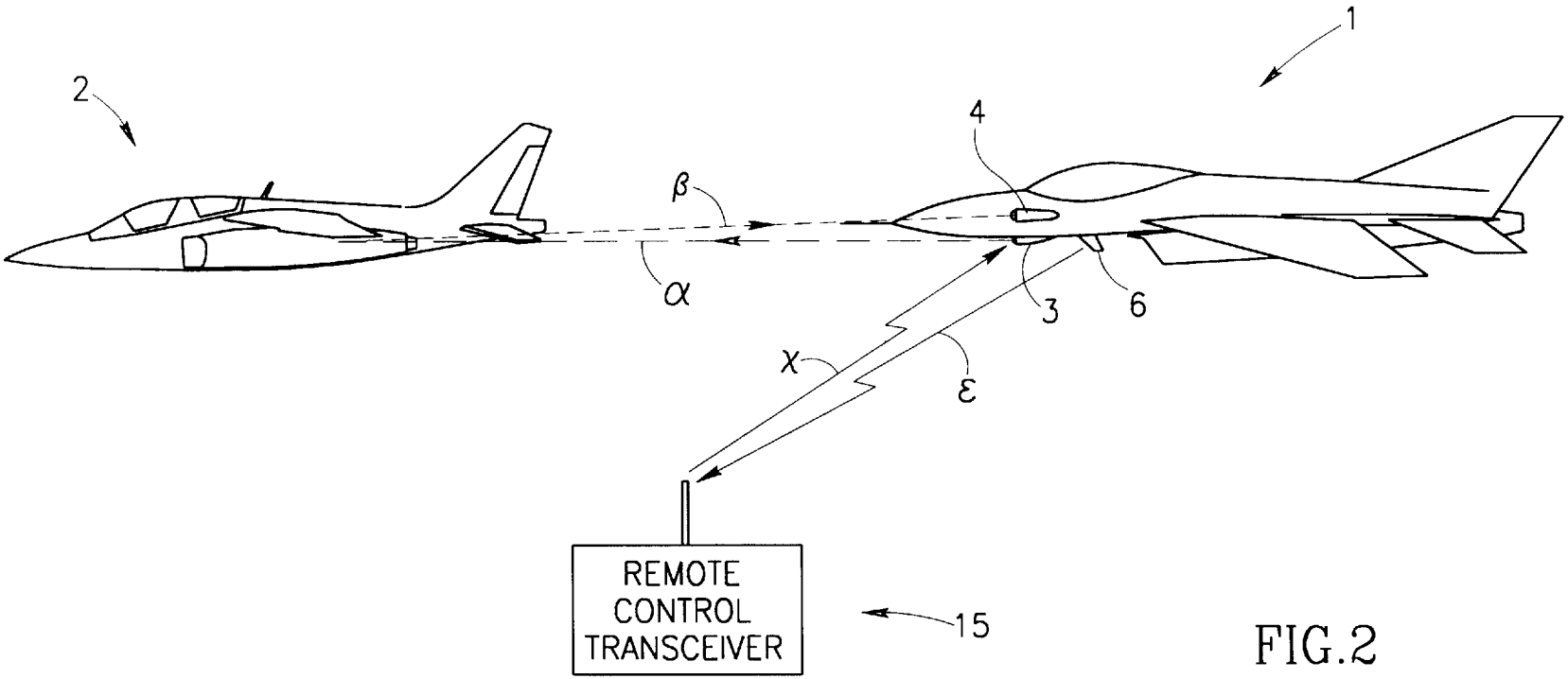
FIG. 2 is a side view of another embodiment of the system.

FIG. 2 is a side view of another embodiment of the system wherein target 2 is of a different aircraft configuration than predator 1. Furthermore, the system further includes a remote control transceiver 15 for both activating first source of coherent electromagnetic radiation 3 by sending a signal along a path, generally indicated as $\chi$, to first source of coherent electromagnetic radiation 3 and receiving a signal from transmitter 6 after detector 4 detects coherent electromagnetic radiation.

Figure 3:
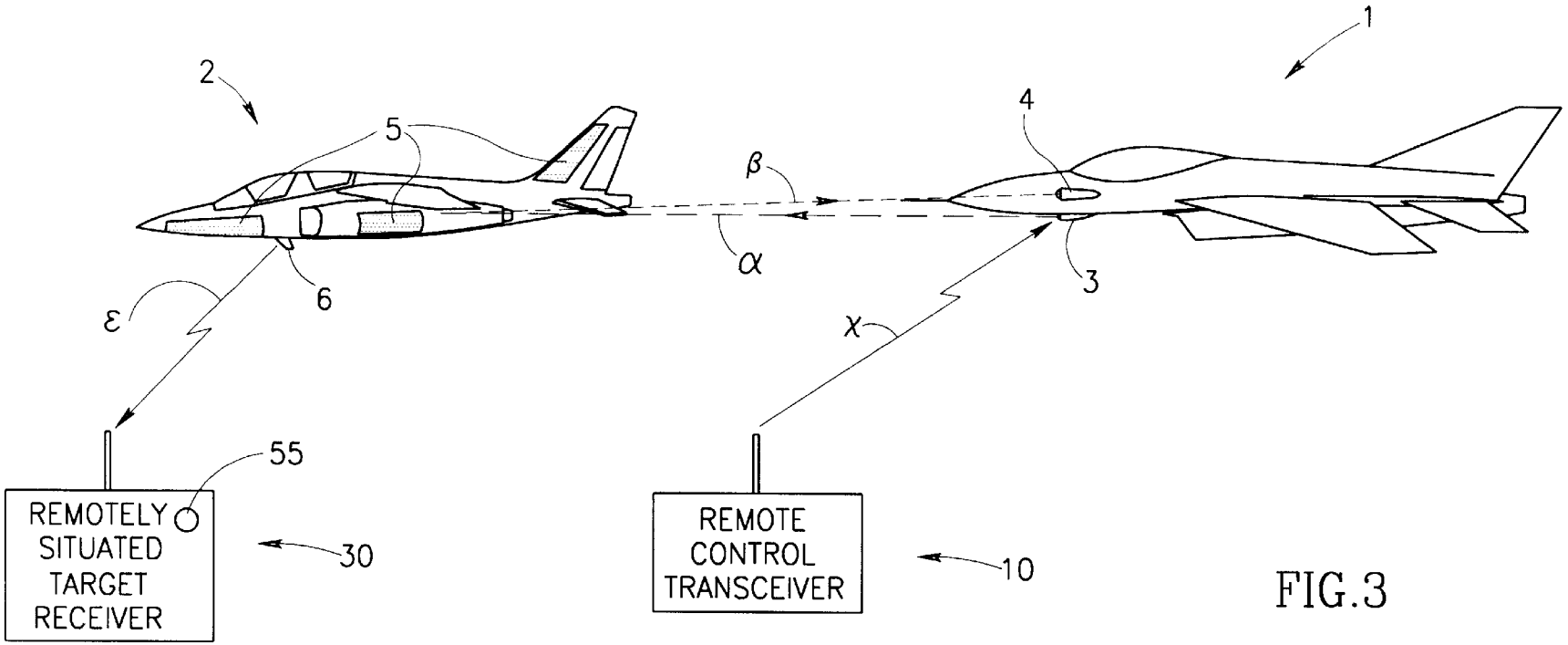
FIG. 3 is a side view of a farther embodiment of the system.

FIG. 3 is a side view of a further embodiment of the system wherein target 2 features a plurality of target coherent electromagnetic radiation detectors 5 connected to transmitter 6 which is responsive to target detectors 5. Transmitter 6 after receiving a signal from target detectors 5, transmits the signal traveling along a path, generally indicated as $\epsilon$. The signal is then picked up by a remotely situated target receiver 30.

Typically, target receiver 30 features a target indicator 55 indicating when target detectors 5 detect coherent electromagnetic radiation.

Alternatively, target indicator 55 features a display for displaying the number of times in which target detectors 5 detects a burst of coherent electromagnetic radiation.

Figure 4:
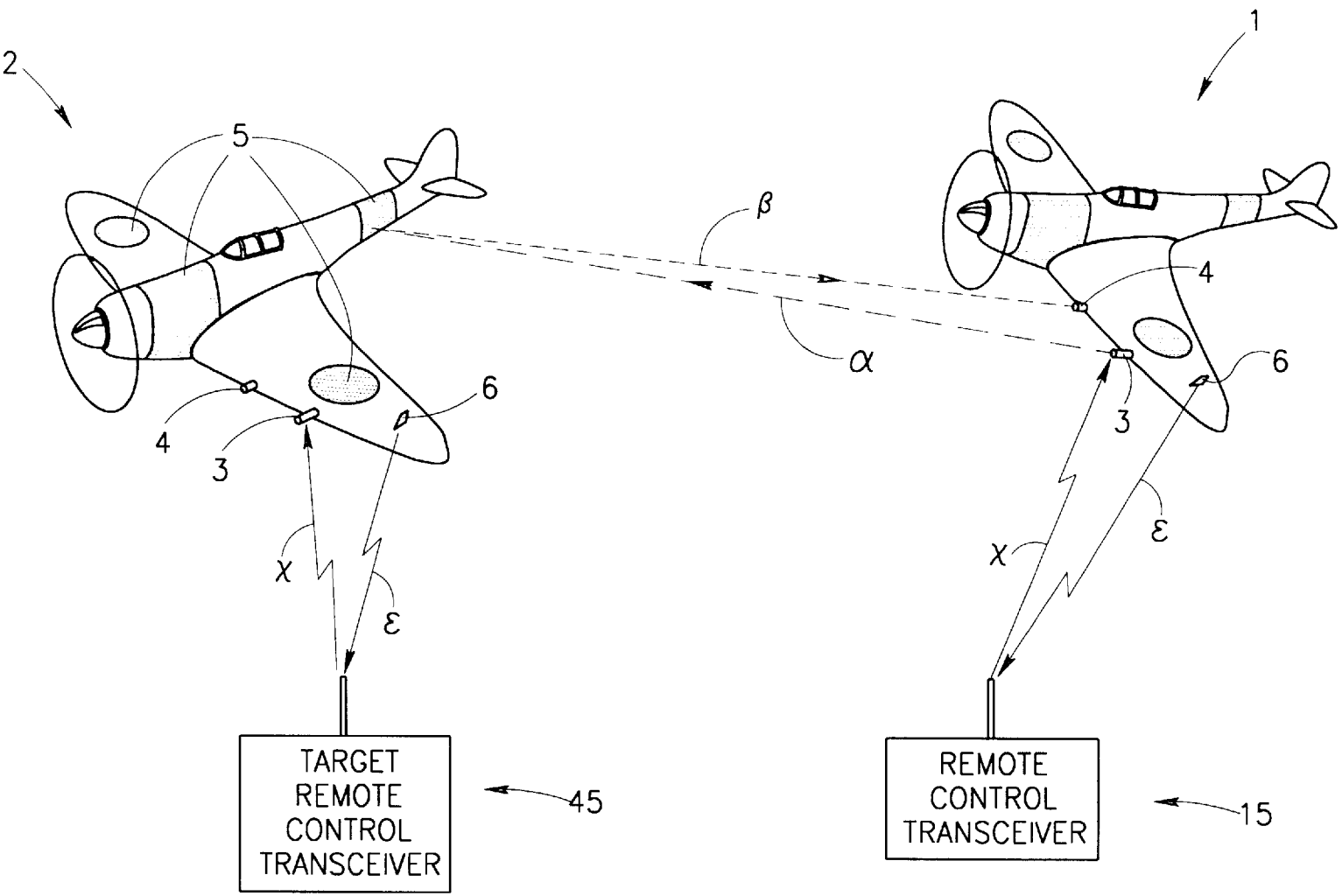
FIG. 4 is a perspective view of another embodiment of the system mounted on model aircraft.

FIG. 4 is a perspective view of another embodiment of the system mounted on model aircraft wherein first radiation source 3 is mounted on predator model 1. Predator 1 is maneuvered so that target 2 is within the line of sight of first radiation source 3. Radiation detector 4 is suitably mounted to receive reflected radiation from target 2 along path $\beta$. Detector 4 is also connected to transmitter 6 mounted on predator 1. Detector 4 transmits a signal to remote control transceiver 15, after coherent electromagnetic radiation "fired" by radiation source 3 at target 2 is reflected from target 2 and returns to detector 4, where it is detected by detector 4. Furthermore, target 2 also features target detectors 5 connected to transmitter 6 which is suitably mounted on target 2. Transmitter 6 after receiving a signal from target detectors 5, transmits the signal traveling along path $\epsilon$. The signal is then picked up by a remotely situated target remote control transceiver 45. Target 2 is also equipped with a second radiation source 3 and detector 4 so that predator and target 2 can change roles. Preferably, second radiation source 3 includes a laser. Target remote control transceiver 45 also activates second coherent electromagnetic source 3 situated on target 2 by sending a signal along path $\chi$ to second radiation source 3.

Preferably, transceiver 45 includes a second indicator responsive incoming signals.

More preferably, first radiation source 3 on the predator platform is deactivated when coherent electromagnetic radiation is detected by target detectors 5.

Due to the fact that predator 1 includes first source 3 and detector 4 and the fact that predator 2 includes second source 3 and detector 5, role reversal is facilitated between predator 1 and target 2. When roles are reversed, target 2 takes the role of predator 1 and predator 1 takes the role of target 2.

Figure 5:
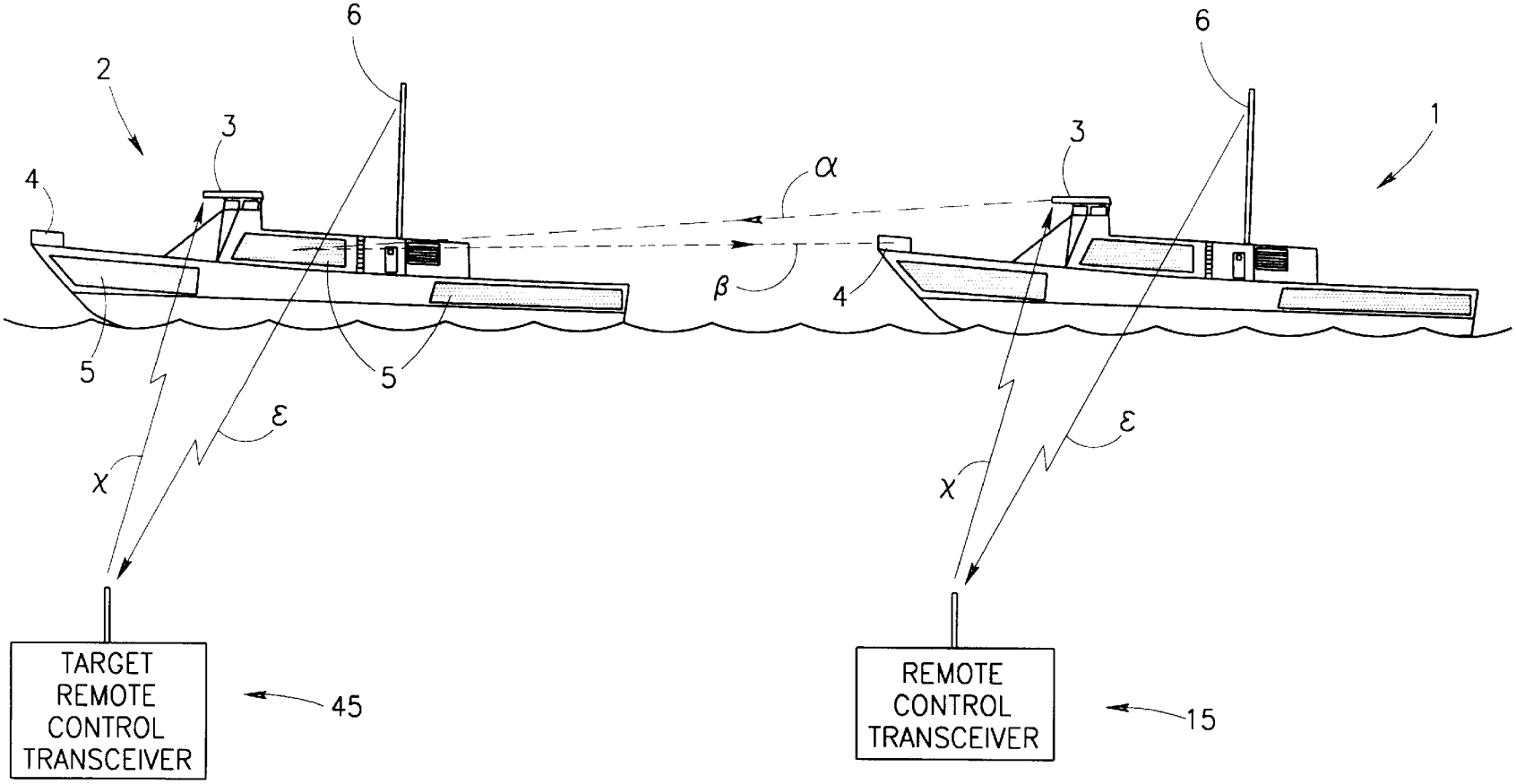
FIG. 5 is a perspective view of another embodiment of the system mounted on model ships.

FIG. 5 is a perspective view of another embodiment of the system mounted on model sea vessels wherein first radiation source 3 is mounted on predator model 1 such that target 2 is within the line of sight of predator 1 and first radiation source 3. Radiation detector 4 is suitably mounted to receive reflected radiation from target 2 along path $\beta$. Detector 4 is also connected to transmitter 6 mounted on predator 1. Transmitter 6 transmits a signal to remote control transceiver 15, after coherent electromagnetic radiation is "fired" by radiation source 3 at target 2, contacting target 2 and returned to detector 4, where it is duly detected by detector 4. Furthermore, target 2 also features target detectors 5 connected to transmitter 6 which is suitably mounted on target 2. Transmitter 6 after receiving a signal from target detectors 5, transmits the signal traveling along path $\epsilon$. The signal is then picked up by target remote control transceiver 45. Target remote control transceiver 45 also activates second coherent electromagnetic source 3 situated on target 2 by sending a signal along path $\chi$ to radiation source 3.

Preferably, second radiation source 3 on target 2 is deactivated when coherent electromagnetic radiation is detected by target detectors 5.

Still preferably, transceiver 45 includes an indicator for indicating when target detectors 5 detect coherent electromagnetic radiation.

Alternatively, the indicator includes a score board for scoring the number of times target detectors 5 detected coherent electromagnetic radiation.

Although the present invention has been described in terms of ship and aircraft platforms, it will be appreciated that the present invention may be used with tanks, submarines or any platform capable of baring a weapon system.

Although the present invention has been described in terms of simulated combat, it will be appreciated that the present invention may be used with real platform in real combat wherein radiation source 3 may be of a sufficient power to be used to actually damage or destroy target 2.

It will be appreciated that the above descriptions are intended only to serve as examples, and that many other embodiments are possible within the spirit and the scope of the present invention.

What is claimed is:

1. A combat simulation system comprising:

(a) a first source of coherent electromagnetic radiation;

(b) a first remote control, in wireless communication with said first source, operated by a user, for activating said first source of coherent electromagnetic radiation;

(c) a target which can be substantially enfilade by said first coherent electromagnetic radiation source;

(d) a first coherent electromagnetic radiation detector situated on said target to receive radiation from said first source; and (e) a transmitter responsive to said first coherent electromagnetic radiation detector.

2. The system of claim 1, further comprising a receiver for receiving a signal from said transmitter.

3. The system of claim 2, wherein said receiver includes an indicator responsive to incoming signals.

4. The system of claim 1, wherein said target includes a second coherent electromagnetic radiation source.

5. The system of claim 4, wherein said second source of coherent electromagnetic radiation includes a laser.

6. The system of claim 1, wherein said target includes a target coherent electromagnetic radiation detector.

7. The system of claim 6, wherein said target includes a transmitter responsive to said target coherent electromagnetic radiation detector.

8. The system of claim 7, further comprising a target remote control for receiving a signal transmitted from said target transmitter.

9. The system of claim 8, wherein said target remote control includes a transceiver for receiving signals from said transmitter and for activating said second source of coherent electromagnetic radiation.

10. The system of claim 9, wherein said transceiver includes an indicator responsive to incoming signals from said transmitter.

11. The system of claim 10, wherein said indicator includes a score board.

12. The system of claim 1, wherein said first source of coherent electromagnetic radiation includes a laser of a sufficient power to damage said target.

13. A method for simulating combat between a predator platform and a target platform comprising the steps of:

(a) providing the predator platform with:

(i) a first source of coherent electromagnetic radiation;

(b) maneuvering the predator platform to a position where the target platform is substantially enfilade by said first coherent electromagnetic radiation source; and (c) activating said first coherent electromagnetic radiation source, such that radiation from said first radiation source illuminates said target;

(d) providing said target with;

(i) a first coherent electromagnetic radiation detector situated on said target to receive radiation from said first source;

(ii) a transmitter responsive to said first coherent electromagnetic radiation detector; and (e) said transmitter being responsive to said radiation detector detecting radiation emanating from said first coherent electromagnetic radiation source.

14. The method of claim 13, further comprising the step of providing a first remote control operated by a user, for activating said first source of coherent electromagnetic radiation.

15. The method of claim 13, wherein the target includes a source of coherent electromagnetic radiation, the method further comprising the step of deactivating said target source of radiation when said target detector detects coherent electromagnetic radiation.

16. The method of claim 13, wherein said method further includes the steps of:

(a) providing the target with:

(i) a second source of said coherent electromagnetic radiation; and (ii) a second coherent electromagnetic radiation detector situated to receive radiation incident on the target platform; and (b) changing roles between said predator platform and said target.

17. The method of claim 16, further comprising the step of deactivating said target source of coherent electromagnetic radiation when said target detector detects coherent electromagnetic radiation.

18. The method of claim 13, wherein the target includes a source of coherent electromagnetic radiation, the method further comprising the step of deactivating said second radiation source when said target detector detects coherent electromagnetic radiation.

19. A combat simulation system comprising:

(a) a predator aircraft;

(b) a first source of coherent electromagnetic radiation situated on said predator aircraft;

(c) a first remote control, in wireless communication with said first source, operated by a user, for activating said first source of coherent electromagnetic radiation;

(d) a target aircraft which can be substantially enfilade by said first coherent electromagnetic radiation source;

(e) a first coherent electromagnetic radiation detector situated to receive reflected radiation from said target; and (f) a transmitter responsive to said first coherent electromagnetic radiation detector.

20. The system of claim 19, further comprising:

(g) a receiver for receiving a signal from said transmitter, wherein said receiver includes an indicator responsive to incoming signals;

(h) a second coherent electromagnetic radiation source situated on said target, which second source includes a laser;

(i) a second coherent electromagnetic radiation detector situated on said target;

(j) a transmitter responsive to said target coherent electromagnetic radiation detector situated on said predator; and (k) a target remote control, including a transceiver for receiving signals from said transmitter and for activating said second source of coherent electromagnetic radiation, wherein said transceiver includes a score board responsive to incoming signals from said transmitter.

21. A combat simulation system comprising:

(a) a predator aircraft;

(b) a first source of coherent electromagnetic radiation situated on said predator aircraft;

(c) a first remote control, in wireless communication with said first source, operated by a user, for activating said first source of coherent electromagnetic radiation;

(d) a target aircraft which can be substantially enfilade by said first coherent electromagnetic radiation source;

(e) a first coherent electromagnetic radiation detector situated on said target to receive radiation from said first source; and (f) a transmitter responsive to said first coherent electromagnetic radiation detector, situated on said predator.

22. The system of claim 21, further comprising:

(g) a receiver for receiving a signal from said transmitter, wherein said receiver includes an indicator responsive to incoming signals;

(h) a second coherent electromagnetic radiation source situated on said target, which second source includes a laser;

(i) a second coherent electromagnetic radiation detector situated on said predator;

(j) a transmitter, situated on said predator, responsive to said second coherent electromagnetic radiation detector; and (k) a target remote control, including a transceiver for receiving signals from said target transmitter and for activating said second source of coherent electromagnetic radiation, wherein said transceiver also includes a score board responsive to incoming signals from said target and predator transmitters.

* * * * *